US005483754A

United States Patent [19]

Gresens

[11] Patent Number: 5,483,754

[45] **Date of Patent: * Jan. 16, 1996**

[54] METHOD AND APPARATUS FOR THE HEAT TREATMENT OF A CONTINUOUSLY MOVING LENGTH OF TEXTILE MATERIAL

[75] Inventor: Harry Gresens, Benningen/Neckar, Germany

[73] Assignee: Bruckner Trockentechnik GmbH & Co., Munich, Germany

[ * ] Notice: The portion of the term of this patent subsequent to Sep. 13, 2006, has been disclaimed.

[21] Appl. No.: 132,507

[22] Filed: Dec. 11, 1987

[30] Foreign Application Priority Data

Dec. 23, 1986 [DE] Germany ..... 36 44 323.9

[51] Int. Cl.[6] ..... F26B 19/00

[52] U.S. Cl. ..... 34/478; 34/514

[58] Field of Search ..... 34/35, 86, 34, 34/79, 478, 479, 514

[56] References Cited

U.S. PATENT DOCUMENTS 3,942,264 3/1976 Zenkner ..... 34/35

*Primary Examiner*—Henry A. Bennet

*Attorney, Agent, or Firm*—Denton L. Anderson; Sheldon & Mak, Inc.

[57] ABSTRACT

The invention relates to the heat treatment of continuously moving length of textile material in a treatment apparatus with at least two successive treatment zones by means of hot gas. After it has been heated, all of the exhaust gas from the first treatment zone is introduced into the second treatment zone as fresh gas. An exhaust gas branch stream drawn off at the end of the second treatment zone is afterburned. The exhaust gas branch stream which has been heated in this way first of all preheats the second exhaust gas branch stream coming from the second treatment zone, and before being discharged into the atmosphere the exhaust gas branch stream coming from the first treatment zone and the fresh air air heated. In this way extremely economic operation of the entire treatment apparatus is provided, with reliable purification and disposable of the exhaust gas.

6 Claims, 1 Drawing Sheet

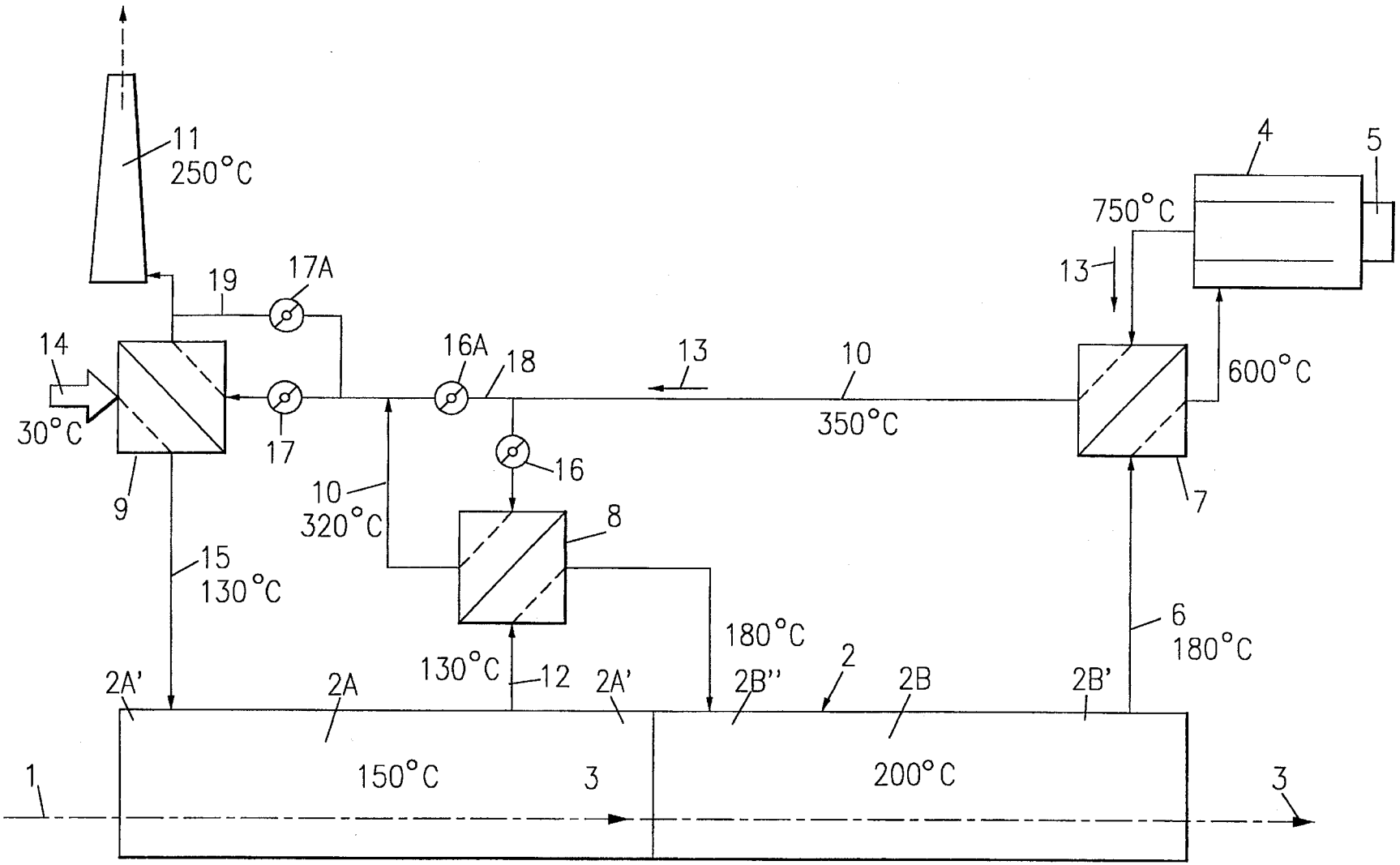
5
4
600°C
750°C
13
7
6
180°C
3
2B'
2B
200°C
10
350°C
2
180°C
2B''
13
8
2A'
3
16
12
18
16A
130°C
150°C
10
320°C
2A
17A
17
19
15
130°C
11
250°C
9
2A'
14
30°C
1

METHOD AND APPARATUS FOR THE HEAT TREATMENT OF A CONTINUOUSLY MOVING LENGTH OF TEXTILE MATERIAL

The invention relates to a method of heat treatment, especially drying and/or fixing, of a continuously moving length of textile material in treatment apparatus with at least two treatment zones through which the length of material flows in succession, according to the preamble to claim 1. The invention also relates to treatment apparatus for carrying out this method.

According to the new legal provisions even the emissions of harmful substances from heat treatment apparatus for lengths of textile material, e.g. tensioning machines and the like, must be severely restricted. If for example such a tensioning machine is used for drying and/or fixing of lengths of textile material after dye treatment thereof with modern textile dyes and so-called carriers, that is to say for drying and/or fixing of alkaline, chlorine-containing substances, then the installation of such a tensioning machine requires an official license, whilst in all other instances of treatment it is at any rate subject to an obligation to register such installation. In the heat treatment of lengths of textile material dyes with alkaline, that is to say chlorine-containing substances, appropriate exhaust gas treatment plant must be installed in order to keep the emissions of harmful substances below the prescribed limit. Even at relatively low exhaust gas emission values the installation of such exhaust gas treatment plant is necessary if there are any complaints in the vicinity about any possible nuisance from emissions.

Various methods and apparatus have therefore been developed in the art by means of which attempts have been made to purify the exhaust gases from such heat treatment apparatus for lengths of textile material. These include in particular condensation, filtering and thermal after-burning methods and apparatus. The thermal afterburning of the exhaust gases alone necessitates not only very high investment costs for the corresponding equipment itself but also considerable energy costs are necessary for operation of this equipment since in many cases the quantity of energy necessary for the burning exceeds the heat requirement of such a heat treatment apparatus, particularly a tensioning machine, by 100%. This means that after the installation of thermal afterburning equipment the whole heat treatment apparatus has a heat consumption which is approximately twice as high as before, that is to say without the thermal afterburning equipment.

A considerable improvement as regards the energy costs and the heat consumption has already been made by a method proposed by the applicant in German Patent No. 28 12 966, as is set out in the preamble to claim 1 as known. In this known method the total quantity of exhaust gas is drawn off from two separate treatment zones in the form of two exhaust gas branch streams, the first exhaust gas branch stream being drawn off from a treatment zone through which the length of material runs first and then being passed to a spray cooler with an appertaining cooling tower in order to remove the condensable constituents contained in the exhaust gas branch stream. Thereupon this first exhaust gas branch stream, now freed from condensable constituents, is heated again in a heat exchanger and some of it is returned to the first treatment zone, some passed to the second treatment zone. At the end of the second treatment zone a second exhaust gas branch stream is drawn off and freed of constituents of harmful substances contained it by burning. The second exhaust gas branch stream which is heated by this burning is then used first of all for preheating the second exhaust gas branch stream delivered to the burning apparatus and then for preheating the first exhaust gas branch stream before it is discharged into the atmosphere. This object is achieved by this invention.

In the present invention the starting point is the knowledge that in heat treatment apparatus, such as for example tensioning machines, combined heat treatment, processes, that is to say generally drying and fixing are carried out in at least two treatment zones through which the length of material passes in succession. In the first treatment zone the length of textile material is dried, and because of the temperatures prevailing there it is essentially water vapour that is produced, whilst in the second treatment zone fixing is carried out above all, and this is carried out at higher temperatures than in the first treatment zone, so that here other substances, *inter alia* spinning and spooling oils, vaporise and are added to the exhaust gas to be drawn off.

In this method according to the invention all of the exhaust gas is drawn off from the rear end (viewed in the direction of movement of the length of material) of the first treatment zone, that is to say generally in the drying part of the treatment apparatus, and this exhaust gas stream is merely heated in a controlled manner to a temperature suitable for passing to the second treatment zone and is then introduced all together as a quantity of fresh gas directly into this second treatment zone, that is to say into the fixing zone according to the general procedure described above. As a result of this not only is the exhaust gas from the first treatment zone which is principally charged with water vapour further heated in an acceptable manner so that it can be used in the subsequent second treatment zone as the necessary quantity of fresh gas, but also this temperature increase means at the same time that this exhaust gas used as fresh gas in the second treatment zone is now prepared for an increased vapour charge and there is no need to fear condensation of the high proportion of water vapour from this exhaust gas.

Since in this method according to the invention all of the exhaust gas from the first treatment zone is used again—after an appropriate increase in temperature—in the second treatment zone and only the exhaust gas drawn off at the end of the second treatment zone is discharged into the atmosphere, costly exhaust gas purification equipment is not necessary for this quantity of exhaust gas from the first treatment zone.

At the material outlet end of the second treatment zone (that is to say generally the fixing zone) an exhaust gas branch stream is continuously drawn off which is to be discharged into the atmosphere. This exhaust gas branch stream drawn off from the second treatment zone is charged with, in addition to water vapour, further vaporised substances, such as for example vaporised spinning and spooling oils and possible other harmful substances, to which may be added a proportion of leaking air from the material outlet slot at this end of the treatment apparatus or the second treatment zone.

This exhaust gas branch stream drawn off from the second treatment zone is then—initially just as in the method according to German Patent No. 28 12 966—passed to the burning apparatus (afterburning apparatus) as it burns previously been greatly preheated with the exhaust gas branch stream which was already heated by the burning of the constituents of harmful substances. After this heated exhaust gas branch stream has preheated the exhaust gas branch stream coming directly from the first treatment zone it is utilized for the further heating of the exhaust gas stream taken from the first treatment zone. However, before this heated exhaust gas branch stream is discharged into the atmosphere, it is first utilised for the heating of the fresh air to be delivered to the treatment apparatus (as the material inlet end thereof). After the exhaust gas branch stream from the second treatment zone has been heated in the burning apparatus it is utilised successively according to the invention, firstly for preheating the exhaust gas branch stream coming directly from the second treatment zone, secondly for further heating of the exhaust gas stream coming from the first treatment zone and thirdly for heating of the fresh air to be newly delivered to the treatment apparatus, and is thereby sufficiently heated or cooled. In this way the total quantity of exhaust gas from the heat treatment apparatus is reduced to approximately 50% by comparison with known constructions, since the exhaust gas from the first treatment zone is used a second time (in the second treatment zone) after it has been further heated to a permissible, controlled extent. This increase in the temperature in the second treatment zone means that—as already partially explained—there is no condensation of water vapour, and in spite of the proportion of water vapour already present the gas is capable of taking up the oil vapours produced (spinning and spooling oils from the fabric) and transporting them to the thermal afterburning apparatus. Since the quantities of exhaust gas from the two treatment zones of this treatment apparatus are of approximately equal magnitude in the combined manner of operation described above (as drying part and subsequent fixing part) this method can be carried out without any significant loss of efficiency.

The invention will be described below in greater detail with the aid of a preferred embodiment of heat treatment apparatus which is illustrated in the drawing (off single sheet of drawings) in the form of a simplified block diagram.

The heat treatment apparatus illustrated in the drawing contains as the actual treatment apparatus for heat treatment of a length of textile material 1 which is moving continuously through it a tensioning machine 2 which is divided into two treatment zones of which the first treatment zone through which the length of material 1 passes first forms a drying part 2*a* and the second treatment zone through which the length of material 1 then passes forms a fixing part 2*b*. This tensioning machine 2 can be constructed in the conventional manner, that is to say both the drying part 2*a* and the fixing part 2*b* can be divided into a plurality of treatment fields. The length of material 1 passes continuously through this tensioning machine 2 in the direction of the arrow 3.

The heat treatment apparatus also contains a burning apparatus constructed as a thermal afterburning apparatus 4, which can be equipped with a burner 5, preferably a gas burner. The material outlet end 2*b'* is connected via an exhaust gas pipe 6 to the thermal afterburning apparatus 4 with a first indirect heat exchanger 7 interposed.

In addition to the first heat exchanger 7 two further in-direct heat exchangers are associated with the tensioning machine 2, namely a second heat exchanger 8 and a third heat exchanger 9. All three heat exchangers 7, 8, 9 are connected to a main gas pipe 10 which goes out from the thermal afterburning apparatus 4 and leads to a chimney 11 and through which an exhaust gas branch stream which has been heated in the thermal afterburning apparatus 4 is first of all passed to one side of the first heat exchanger 7, then—at least partially—to one side of the second heat exchanger 8 and then—again at least partially—to one side of the third heat exchanger 9 before it is discharged into the atmosphere via the chimney 11. The exhaust gas stream coming from the material outlet end 2*b'* of the fixing part 2*b* is delivered via the exhaust gas pipe 6 to the other side of the first heat exchanger 7—as already indicated—for alteration before it is introduced into the thermal afterburning apparatus 4 so that the constituents of harmful substances contained in it can be burned there. All of the exhaust gas from the rear end 2*a'*—viewed in the direction of movement of the material (arrow 3)—of the drying part 2*a* is delivered via a gas pipe 12 to the second side of the second heat exchanger 8 so that it can merely be heated further there in a controlled manner before this total exhaust gas stream is introduced as fresh gas into the front end 2*b"*—again viewed in the direction of movement of the material—of the fixing port 2*b*. The third heat exchanger 9, which is arranged after the second heat exchanger 8 in the direction of flow (arrow 13) is supplied with fresh air (arrow 14) from the space surrounding the treatment apparatus, and the fresh air warmed in this way is introduced via a fresh air delivery pipe 15 into the material inlet and 2*a"* of the drying part 2*a* and thus to the tensioning machine.

In the main exhaust gas pipe 10 of the heated exhaust gas branch stream, that is to say in the sections of this main exhaust gas pipe 10 which lead from the first heat exchanger 7 to the second heat exchanger 8 and from the second heat exchanger 8 to the third heat exchanger 9, are provided in each case two bypass regulating valves 16, 16*a* and 17, 17*a* respectively and one bypass pipe 18 or 19 respectively, by means of which at least a proportion of the heated exhaust gas stream can be redirected in an accurately controllable manner to bypass on the one hand the second heat exchanger 8 and on the other hand the third heat exchanger 9. These bypass arrangements make it possible to operate the two heat exchangers 8 and 9 in an accurately controllable manner, that is to say to heat all of the exhaust gas stream from the drying part 2*a* in a controlled manner by means of the second heat exchanger 2*a* to exactly the appropriate temperature for delivery to the fixing part 2*b* and to heat the fresh air delivered to the heat exchanger 9 at 14, also in a controllable manner, to the appropriate temperature for introduction into the drying part 2*a*.

The fresh air to be introduced at the material inlet end 2*a"* into the drying part 2*a* is preferably heated to a temperature which corresponds approximately to the temperature of the exhaust gas drawn off at the rear end 2*a'* of the drying part 2*a*. The exhaust gas stream drawn off here is then increased in temperature, also in a controllable manner, in the second heat exchanger 8 (for introduction as a quantity of fresh gas into the fixing part 2*b*), and this increased temperature then corresponds approximately to the temperature of the gas branch stream (pipe 6) drawn off at the end of this fixing part 2*b*.

In a practical realisation of this method according to the invention for drying and fixing of the continuously moving length of textile material 1 it may be assumed that the fresh air delivered to the third heat exchanger 9 at 14 has an ambient temperature of approximately 30° C. and that this fresh air is then heated in the third heat exchanger 9 to approximately 130° C. In the drying part 2*a* of the tensioning machine 2 the hot gas stream which circulates there has a temperature of approximately 150° C. The exhaust gas drawn off from the drying part 2*a* with the aid of the exhaust gas pipe 12 has a temperature of approximately 130° C. For the introduction of this exhaust gas as fresh gas into the fixing part 2 *b* of the tensioning machine 2 this exhaust gas or exhaust gas stream must advantageously be heated (in a controlled manner) in the second heat exchanger 8 to a temperature of approximately 180° C. In the fixing part 2*b* the temperature of the hot gas stream circulated there amounts to approximately 200° C., whilst the exhaust gas branch stream drawn off at the material outlet end 2b' via the exhaust gas pipe 6 has a temperature of approximately 180° C. If the exhaust gas stream drawn off here were to be delivered at this temperature (180° C.) direct to the thermal afterburning installation 4, then this would mean that quite a considerable additional quantity of heat energy must be delivered to this installation 4 via its burner 5 in order to carry out the thermal afterburning of the constituents of harmful substances contained in this branch gas stream at approximately 700° to 800° C. However, since the exhaust gas branch stream drawn off from the fixing part 2b via the pipe 6 is initially preheated to approximately 500° to 650° C., preferably 600° C., in the first heat exchanger 7 with the aid of the exhaust gas branch stream coming from the afterburning installation 4 where it has been heated to approximately 700° to 750° C., only a relatively small additional supply of heat energy is necessary via the burner 5 to the thermal afterburning installation 4. With the temperature conditions given above it can also be assumed that the heated exhaust gas branch stream leaves the first heat exchanger 7 at a temperature of approximately 350° C., is led at least in part via the second heat exchanger 8 and there cooled to approximately 320° C. before it flows through the third heat exchanger 9 and is discharged into the atmosphere through the chimney 11 at approximately 250° C. Thus, in contrast to the known method and apparatus, with this construction according to the invention, with relatively low plant or equipment costs it is possible on the one hand for the total quantity of exhaust gas from the heat treatment apparatus to be considerably reduced, namely by about a half (50%), and on the other hand at the same time for the quantity of exhaust gas to be discharged into the atmosphere (that is the total exhaust gas branch stream drawn off from the fixing part 2b) to be satisfactorily purified in practice with significant additional energy requirement (in spite of the thermal afterburning installation 4) and thus use the treatment apparatus as a whole in accordance with the new regulations on emissions.

I claim:

1. A method for drying and fixing a continuously moving length of textile material in a treatment apparatus wherein the length of textile material is serially passed through a drying zone along a path from a front end of the drying zone to a rear end of the drying zone, and then through a fixing zone along a path from a front end of the fixing zone to a rear end of the fixing zone comprising the steps of:

(a) heating a single stream of gas to a first temperature, introducing the stream of gas into the drying zone and therein contacting the length of textile material with the stream of gas;

(b) withdrawing the single stream of gas from the rear end of the drying zone and then heating the stream of gas to a second temperature higher than the first temperature;

(c) introducing the single stream of gas heated to the second temperature into the fixing zone and therein contacting the length of textile material with the stream of gas;

(d) withdrawing the single stream of gas from the rear end of the fixing zone, heating the stream of gas to a third temperature higher than the second temperature, and then contacting the stream of gas with a flame to burn harmful substances contained within the stream of gas and to produce an atmospheric exhaust stream; and (e) discharging the atmospheric exhaust stream to the atmosphere;

wherein the single stream of gas is heated in steps (a), (b), and (d) by indirect contact with a portion of the atmospheric exhaust stream.

2. The method defined in claim 1 wherein the stream of gas introduced into the drying zone in step (a) is taken from the space surrounding the treatment apparatus.

3. The method defined in claim 1 wherein the first temperature is between about 100° C. and about 180° C. and the second temperature is between about 170° C. and about 220 ° C.

4. The method defined in claim 3 wherein the temperature of the gas stream withdrawn from the drying zone in step (b) is between about 80° C. and about 160° C. and the temperature of the gas stream withdrawn from the rear end of the fixing zone in step (d) is between about 150° C. and 210° C.

5. The method defined in claim 1 wherein the third temperature is between about 550° C. and about 650° C.

6. A heat treatment apparatus for carrying out the method as claimed in claim 1, comprising:

(a) an enclosed drying zone having a front end and a rear end;

(b) an enclosed fixing zone having a front and a rear end;

(c) a burning apparatus, having an inlet and an outlet, adapted to contact a stream of gas with flame to burn harmful substances contained within the stream of gas;

(d) a first indirect heat exchanger having a first pass in indirect thermal contact with a second pass, the first pass having an inlet and an outlet, and the second pass having an inlet and an outlet;

(e) a second indirect heat exchanger having a first pass in indirect thermal contact with a second pass, the first pass having an inlet and an outlet, and the second pass having an inlet and an outlet;

(f) a third indirect heat exchanger having a first pass in indirect contact with a second pass, the first pass having an inlet and an outlet, and the second pass having an inlet and an outlet;

(g) conduit means for connecting in fluid communication;

(i) the outlet of the first pass of the first heat exchanger and the front end of the drying zone;

(ii) the rear end of the drying zone and the inlet and of the first pass of the second heat exchanger;

(iii) the outlet of the first pass of the second heat exchanger and the front end of the fixing zone;

(iv) the rear end of the fixing zone and the inlet of the first pass of the third heat exchanger;

(v) the outlet of the first pass of the third heat exchanger and the inlet of the burning apparatus;

(vi) the outlet of the burning apparatus and the inlet of the second pass of the third heat exchanger;

(vii) the outlet to the second pass of the third heat exchanger and the inlet of the second pass of the second heat exchanger; and (viii) the outlet of the second pass of the second heat exchanger and the inlet of the second pass of the first heat exchanger.

* * * * *